US010099111B2

(12) United States Patent
Shigeta

(10) Patent No.: US 10,099,111 B2
(45) **Date of Patent: *Oct. 16, 2018**

(54) TABLE GAME SYSTEM

(71) Applicant: Angel Playing Cards Co., Ltd., Shiga (JP)

(72) Inventor: Yasushi Shigeta, Shiga (JP)

(73) Assignee: Angel Playing Cards Co., Ltd., Shiga (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/496,295

(22) Filed: Apr. 25, 2017

(65) Prior Publication Data

US 2017/0225063 A1 Aug. 10, 2017

Related U.S. Application Data

(63) Continuation of application No. 14/558,579, filed on Dec. 2, 2014, now Pat. No. 9,662,562, which is a (Continued)

(30) Foreign Application Priority Data

Oct. 18, 2010 (JP) ..... 2010-247886

(51) Int. Cl.
*A63F 1/14* (2006.01)
*A63F 9/24* (2006.01)

(52) U.S. Cl.
CPC ..... *A63F 1/14* (2013.01); *A63F 2009/2439* (2013.01); *A63F 2009/2445* (2013.01)

(58) Field of Classification Search
CPC ..... A63F 1/12
(Continued)

(56) References Cited

U.S. PATENT DOCUMENTS 3,586,334 A 6/1971 Baumann
4,534,562 A 8/1985 Cuff et al.
(Continued)

FOREIGN PATENT DOCUMENTS

CN 2819325 9/2006
JP 9-218933 8/1997
(Continued)

OTHER PUBLICATIONS

International Search Report of PCT/JP2011/005793 dated Jan. 10, 2012.

(Continued)

*Primary Examiner* — John E Simms, Jr.
*Assistant Examiner* — Dolores Collins
(74) *Attorney, Agent, or Firm* — Norton Rose Fulbright US LLP

(57) ABSTRACT

A table game system with a card counting apparatus having: an optical sensor that is placed below the bottom of a card storage unit that stores a plurality of cards and receives reflected light of light applied to end surfaces of the plurality of cards stored in the card storage unit; and a playing card counting unit that receives a signal from the optical sensor and counts the number of the plurality of cards stored in the card storage unit. The optical sensor is placed so as to receive reflected light from end surfaces of all of the plurality of cards stored in the card storage unit, or configured to be movable across a predetermined section by a sensor scanning unit so as to receive reflected light from end surfaces of all of the plurality of cards stored in the card storage unit.

6 Claims, 9 Drawing Sheets

Related U.S. Application Data continuation-in-part of application No. 13/878,977, filed as application No. PCT/JP2011/005793 on Oct. 17, 2011, now Pat. No. 8,899,588.

(58) Field of Classification Search
USPC ..... 273/149 R
See application file for complete search history.

(56) References Cited

U.S. PATENT DOCUMENTS

| | | | | |
|---|---|---|---|---|
| 4,619,367 | A | 10/1986 | Dorman | |
| 4,912,317 | A | 3/1990 | Mohan et al. | |
| 4,995,615 | A | 2/1991 | Cheng | |
| 5,067,713 | A * | 11/1991 | Soules | A63F 1/14 273/149 P |
| 5,169,155 | A | 12/1992 | Soules et al. | |
| 5,374,061 | A * | 12/1994 | Albrecht | A63F 1/14 273/149 R |
| 5,431,399 | A | 7/1995 | Kelley | |
| 5,522,623 | A | 6/1996 | Soules et al. | |
| 5,534,690 | A | 7/1996 | Goldenberg et al. | |
| 5,722,893 | A * | 3/1998 | Hill | A63F 1/14 273/149 R |
| 5,989,122 | A * | 11/1999 | Roblejo | A63F 1/14 273/149 P |
| 6,039,650 | A * | 3/2000 | Hill | A63F 1/14 273/149 R |
| 6,042,150 | A * | 3/2000 | Daley | A63F 1/00 250/271 |
| 6,173,267 | B1 | 1/2001 | Cairns | |
| 6,220,960 | B1 | 4/2001 | Kryzhanovsky | |
| 6,233,497 | B1 | 5/2001 | Kachi et al. | |
| 6,582,301 | B2 * | 6/2003 | Hill | A63F 1/14 273/149 R |
| 6,640,974 | B2 | 11/2003 | Malone | |
| 6,886,829 | B2 | 5/2005 | Hessing et al. | |
| 7,029,009 | B2 * | 4/2006 | Grauzer | A63F 1/14 273/149 P |
| 7,264,241 | B2 * | 9/2007 | Schubert | A63F 1/14 273/138.2 |
| 7,357,321 | B2 | 4/2008 | Yoshida et al. | |
| 7,374,170 | B2 | 5/2008 | Grauzer et al. | |
| 7,556,197 | B2 | 7/2009 | Yoshida et al. | |
| 7,660,676 | B2 * | 2/2010 | Hirata | G01N 27/44721 702/19 |
| 7,753,373 | B2 * | 7/2010 | Grauzer | A63F 1/12 273/148 R |
| 7,762,889 | B2 * | 7/2010 | Shigeta | A63F 1/14 273/149 R |
| 7,769,232 | B2 * | 8/2010 | Downs, III | A63F 1/14 273/148 A |
| 7,933,448 | B2 * | 4/2011 | Downs, III | A63F 1/14 273/148 A |
| 8,221,244 | B2 * | 7/2012 | French | G07F 17/32 463/11 |
| 8,308,163 | B2 * | 11/2012 | Shigeta | A63F 1/14 273/149 R |
| 8,387,983 | B2 | 3/2013 | Shigeta | |
| 8,556,262 | B2 * | 10/2013 | Shigeta | A63F 1/14 273/149 R |
| 8,567,786 | B2 | 10/2013 | Shigeta | |
| 8,590,896 | B2 * | 11/2013 | Krenn | A63F 1/14 273/149 P |
| 8,657,287 | B2 * | 2/2014 | Krishnamurty | A63F 1/18 273/149 R |
| 8,899,588 | B2 * | 12/2014 | Shigeta | A63F 1/14 273/149 R |
| 8,920,229 | B1 * | 12/2014 | Chun | G07F 17/3293 273/149 P |
| 8,969,802 | B1 * | 3/2015 | Blazevic | A63F 1/12 250/330 |
| 9,092,935 | B2 * | 7/2015 | Merati | G07F 17/3244 |
| 9,474,958 | B2 * | 10/2016 | Shigeta | A63F 1/14 |
| 9,662,562 | B2 * | 5/2017 | Shigeta | A63F 1/14 |
| 2004/0026636 | A1 | 2/2004 | Shigeta | |
| 2004/0178328 | A1 | 9/2004 | Graber et al. | |
| 2006/0183540 | A1 * | 8/2006 | Grauzer | G07F 17/32 463/29 |
| 2006/0219797 | A1 | 10/2006 | Koyama et al. | |
| 2007/0102879 | A1 | 5/2007 | Stasson | |
| 2007/0111773 | A1 * | 5/2007 | Gururajan | G07F 17/32 463/11 |
| 2010/0103643 | A1 | 4/2010 | Lin et al. | |
| 2010/0224516 | A1 | 9/2010 | Abell | |
| 2010/0320684 | A1 | 12/2010 | Mali | |
| 2010/0327525 | A1 * | 12/2010 | Shigeta | A63F 1/02 273/149 R |
| 2011/0079959 | A1 | 4/2011 | Hartley | |

FOREIGN PATENT DOCUMENTS

| | | |
|---|---|---|
| JP | 9-223217 | 8/1997 |
| JP | 11-102427 | 4/1999 |
| JP | 2003250950 | 9/2003 |
| JP | 2006271596 | 10/2006 |
| JP | 2009213520 | 9/2009 |
| WO | 02064225 | 8/2002 |

OTHER PUBLICATIONS

Chinese Patent Application No. 201180036176.7, Office Action and Search Report dated Jul. 28, 2014.

Office Action for the corresponding Australian Application No. 2017201491 dated Feb. 22, 2018.

* cited by examiner

TABLE GAME SYSTEM

CROSS-REFERENCE TO RELATED APPLICATIONS

This application is a continuation of U.S. patent application Ser. No. 14/558,579, filed Dec. 2, 2014 and entitled "TABLE GAME SYSTEM," which in turn is a continuation-in-part of U.S. patent application Ser. No. 13/878,977, filed Apr. 11, 2013 and entitled "CARD READING APPARATUS AND TABLE GAME SYSTEM," now U.S. Pat. No. 8,899,588; which is a U.S. National Stage Entry under 35 U.S.C. § 371 of PCT International Application No. PCT/JP2011/005793, filed Oct. 17, 2011; which claims priority to Japanese Application No. JP 2010-247886, filed Oct. 18, 2010. The contents of each of these applications are hereby incorporated by reference in their entirety.

TECHNICAL FIELD

The present invention relates to a card shooter apparatus used on a table for a table game, and a table game system using the card shooter apparatus. The present invention further relates to a card shooter apparatus including a card shooter unit that includes a card storage unit that stores a plurality of cards in a horizontal stack, and allows a dealer to slide and take out cards from the card storage unit and distribute the cards onto a game table to assist progress of a game, and having a function of preventing cheating, and a table game system.

BACKGROUND ART

An apparatus that detects that a plurality of cards used for a table game are prepared in proper quantity is disclosed in International Publication No. WO02/064225A1. This literature discloses a technique in which a card has a code indicating a type of the card using UV ink or the like that reacts with a UV light, and it is detected whether a card deck used for a table game is a predetermined one by reading this code (Patent Literature 1).

There is also a technique in which information identifying a card is recorded in an IC chip or the like instead of using UV ink, and the IC chip or the like is embedded in the card together with an antenna that radiates electromagnetic waves so that the card can be remotely identified (Patent Literature 2).

In the above conventional apparatus, stacked cards are fed one by one using a roller or the like, and a UV code of each of separated cards is read to inspect the cards, thereby preventing cheating. For a table game, for example, a baccarat game, a card shooter apparatus storing a plurality of decks (generally six or eight decks) is used on a table, and a predetermined number of cards in the plurality of decks (416 cards in eight decks) in the card shooter apparatus are required to be prepared before start of the game. Further, if it is found that the predetermined number of cards in the plurality of decks (416 cards in eight decks) in the card shooter apparatus are not prepared at finish of the game, a strict rule may be applied to cancel all games that the card shooter apparatus has played. However, the conventional apparatus separates the cards one by one using the roller or the like and inspects the cards, and thus cannot inspect that the predetermined number of cards (416 cards in eight decks) are prepared with the plurality of cards being in the card shooter apparatus.

If cards in which an IC chip or the like is embedded and that can be remotely identified are used, a plurality of cards can be remotely inspected while being in a card shooter apparatus. However, such remote reading of information may have a possibility of theft of information by an advanced hacking technique, and cannot be used for table games.

CITATION LIST

Patent Literature

Patent Literature 1: WO02/064225;
Patent Literature 2: JP2006-271596A

SUMMARY OF THE INVENTION

Technical Problem

The present invention is achieved under the above described background. The present invention has an object to provide a card shooter apparatus and a table game system that allow inspection that a predetermined number of cards (416 cards in eight decks) are prepared with a plurality of cards being in the card shooter apparatus. The present invention has another object to provide a card shooter apparatus and a table game system that can determine mixing of a fraudulent card with a plurality of cards being in the card shooter apparatus.

Solution to Problem

An aspect of the present invention is a table game system comprising: a predetermined number of decks of game cards which are shuffled in a random order and individually packaged as one package, an unique ID code is attached to the package of shuffled game cards, an ID code reader for obtaining the ID code of the packages at the game table to identify the package which will be used for the next game, a card storage unit that stores the predetermined number of decks of game cards plucked out from the package, an optical sensor that receives reflected light of light applied to end surfaces of the plurality of cards stored in the card storage unit; a playing card counting unit that receives a signal from the optical sensor and counts the quantity of cards stored in the card storage unit; a count determination unit that determines from an output of the playing card counting unit whether the quantity of the cards stored in the card storage unit is a predetermined quantity, and an output unit that outputs the determination of the count determination unit with the ID code of the package in which the plurality of cards stored in the card storage unit, wherein the optical sensor is placed so as to receive reflected light from end surfaces of all of the plurality of cards stored in the card storage unit, or configured to be movable across a predetermined section by a sensor scanning unit so as to receive reflected light from end surfaces of all of the plurality of cards stored in the card storage unit and the playing card counting unit is configured to decide the quantity of the cards based on information obtained from the optical sensor on a minute clearance between the plurality of cards stored and stacked in the card storage unit or a black portion present in the cards, or both the minute clearance and the black portion.

As described below, the present invention includes other aspects. Thus, disclosure of the invention is intended to provide a part of aspects of the present invention, and not intended to limit the scope of the invention described and claimed herein.

DESCRIPTION OF EMBODIMENTS

Figure 1:
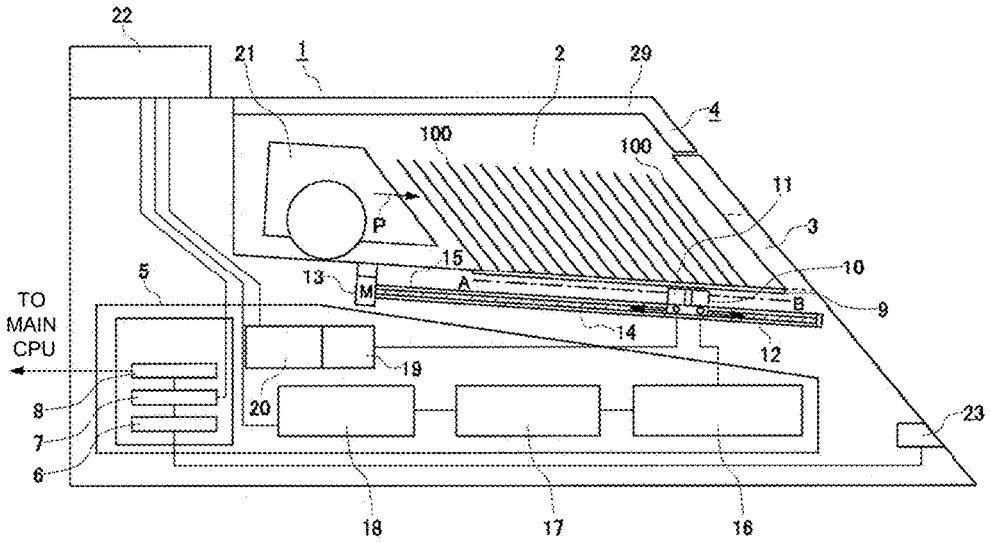
FIG. 1 illustrates an outline of a card shooter apparatus in a table game system in Embodiment 1 of the present invention.

Now, the present invention will be described in detail. The detailed description below and the accompanying drawings do not limit the invention.

To solve the conventional problem described above, the present invention provides a card shooter apparatus including: a card shooter unit including a card storage unit that stores a plurality of cards in a horizontal stack, and an opening through which the cards can be slid from the card storage unit and taken out onto a game table; a card reading unit that reads the number of cards taken out from the card shooter unit; a win/loss determination unit that determines win/loss of a card game based on information on the number of the plurality of cards from the card reading unit; a communication unit that transmits the information on the number of cards read by the card reading unit; an optical sensor that receives reflected lights of lights applied to end surfaces of the plurality of cards stored in the card storage unit; a playing card counting unit that receives a signal from the optical sensor and counts the number of the plurality of cards stored in the card storage unit; and a count determination unit that determines from an output of the playing card counting unit whether the number of the plurality of cards stored in the card storage unit is a predetermined number and outputs a result, wherein the optical sensor is placed so as to receive reflected lights from end surfaces of all of the plurality of cards stored in the card storage unit, or configured to be movable across a predetermined section by a sensor scanning unit so as to receive reflected lights from end surfaces of all of the plurality of cards stored in the card storage unit.

Further, in the card shooter apparatus of the present invention, the playing card counting unit may be configured to decide the number of the plurality of cards based on information obtained from the optical sensor on a minute clearance between the plurality of cards stored and stacked in the card storage unit or a black portion present in the cards, or both the minute clearance and the black portion.

To further solve the conventional problem described above, the present invention provides a table game system including: cards each having a molecular sequence for encoding deck information indicating a deck of cards; and a card shooter apparatus including a card shooter unit including a card storage unit that stores a plurality of cards in a stack, and an opening through which the cards can be slid from the card storage unit and taken out onto a game table, wherein the card shooter apparatus further includes a card reading unit that reads the number of cards taken out from the card shooter unit, a win/loss determination unit that determines win/loss of a card game based on information on the number of the plurality of cards from the card reading unit, a communication unit that transmits the information on the number of cards read by the card reading unit, an optical sensor that receives reflected lights of lights applied to end surfaces of the plurality of cards stored in the card storage unit, a molecular sequence sensor that reads molecular sequences of the plurality of cards stored in the card storage unit and obtains molecular sequence information, a playing card counting unit that receives a signal from the optical sensor and counts the number of the plurality of cards stored in the card storage unit, a deck information obtaining unit that receives a signal from the molecular sequence sensor and obtains deck information on the plurality of cards stored in the card storage unit, a count determination unit that determines from an output of the playing card counting unit whether the number of the plurality of cards stored in the card storage unit is a predetermined number and outputs a result, and a deck information determination unit that determines from an output of the deck information obtaining unit whether the plurality of cards stored in the card storage unit each have predetermined deck information and outputs a result, the optical sensor and the molecular sequence sensor are placed so as to receive reflected lights from end surfaces of all of the plurality of cards stored in the card storage unit and the molecular sequence information, or configured to be movable across a predetermined section by a sensor scanning unit so as to receive reflected lights from end surfaces of all of the plurality of cards stored in the card storage unit and the molecular sequence information.

Further, the playing card counting unit may be configured to decide the number of the plurality of cards based on information obtained from the optical sensor on a minute clearance between the plurality of cards stored and stacked in the card storage unit or a black portion present in the cards, or both the minute clearance and the black portion.

The card shooter apparatus of the present invention allows inspection that a predetermined number of cards (416 cards in eight decks) are prepared with the plurality of cards being in the card shooter apparatus, and further can determine mixing of a fraudulent card with the plurality of cards being in the card shooter apparatus.

Embodiment 1

Now, Embodiment 1 of a table game system of the present invention will be described in detail.

FIG. 1 illustrates an outline of a card shooter apparatus 1 in a table game system in Embodiment 1. In FIG. 1, the card shooter apparatus 1 includes a card shooter unit 4 including a card storage unit 2 that stores a plurality of cards 100 in a horizontal stack, and an opening 3 through which the cards 100 can be slid from the card storage unit 2 and taken out onto a game table (not shown). A control device 5 constituted by a program storage unit, a computer device, or the like is placed in a lower part of the card shooter unit 4. The control device 5 includes a card reading unit 6 that reads information (rank (number) and suit (heart, club, or the like)) on the cards 100 taken out from the card shooter unit 4, a win/loss determination unit 7 that determines win/loss of a card game based on the information on the number of the plurality of cards from the card reading unit 6, and a communication unit 8 that transmits the information on the number of cards read by the card reading unit 6 to an external main computer (not shown).

A transparent bottom plate 9 is provided on a bottom of the card storage unit 2, and an optical sensor 10 that receives reflected lights of lights applied to end surfaces of the plurality of cards 100 stored in the card storage unit 2, and a DNA sensor 11 that obtains DNA information from a DNA-containing coating (described later) applied to the cards 100 stored in the card storage unit 2 are placed below the bottom plate 9. The optical sensor 10 and the DNA sensor 11 are configured to be movable across a predetermined section by a sensor scanning device 12. Specifically, the optical sensor 10 and the DNA sensor 11 are coupled to a drive shaft 14 rotationally driven by a motor 13 and having a helical grove in an outer periphery, and configured to be movable across a section (A-B) along a guide 15 so as to receive reflected lights from end surfaces of all of the plurality of cards 100 stored in the card storage unit 2 and the DNA information.

The control device 5 further includes a playing card counting unit 17 that processes a signal from the optical sensor 10 via an image processing unit 16 that converts an image signal from the optical sensor 10 into a digital signal, and counts the number of the plurality of cards 100 stored in the card storage unit 2, a count determination unit 18 that determines from an output of the playing card counting unit 17 whether the number of the cards stored in the card storage unit 2 is a predetermined number, a deck information obtaining unit 19 that receives a signal from the DNA sensor 11 and obtains deck information on the plurality of cards 100 stored in the card storage unit 2, and a deck information determination unit 20 that receives an output of the deck information obtaining unit 19, determines whether the plurality of cards 100 stored in the card storage unit 2 each have predetermined deck information, and outputs a result. An important point is that the deck information obtaining unit 19 that obtains deck information on the cards 100 does not have a function of reading information (rank (number) and suit (heart, club, or the like)) on the cards 100, and does not read such information. The information (rank (number) and suit (heart, club, or the like)) on the card 100 is read by the card reading unit 6 and a card information obtaining unit 23, which are provided separately from the deck information obtaining unit 19 that obtains the deck information on the cards 100. The communication unit 8 is configured to transmit a determination result of the deck information determination unit 20. The plurality of cards 100 in the card storage unit 2 are pressed in a direction of arrow P by a card pressing member 21 with a roller so that no clearance is created between the cards 100.

In an upper part of the card shooter apparatus 1, a display device 22 is provided that displays a win/loss determination result of the card game by the win/loss determination unit 7. The display device 22 includes a display unit that displays the win/loss determination result of the card game, and also a second display unit that displays a determination result by the count determination unit 18, and a third display unit that displays a determination result by the deck information determination unit 20.

Figure 2A:
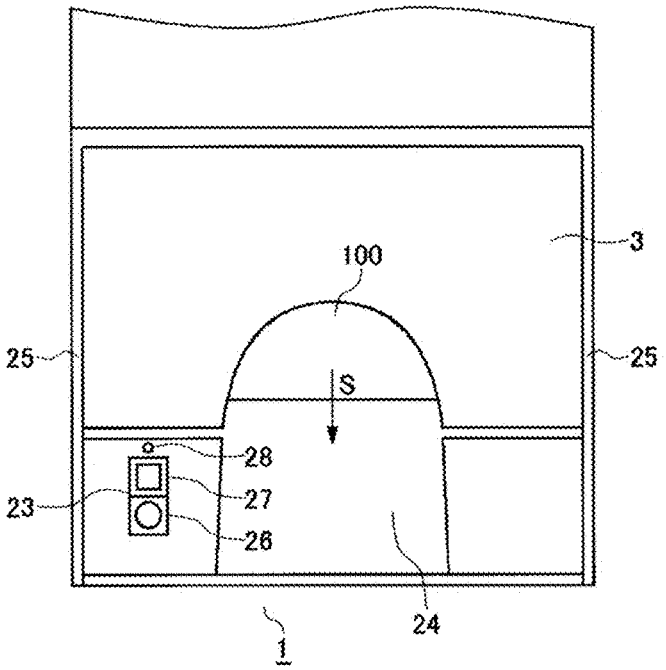
FIG. 2A is a partial plan view of the card shooter apparatus in Embodiment 1 of the present invention.
Figure 2B:
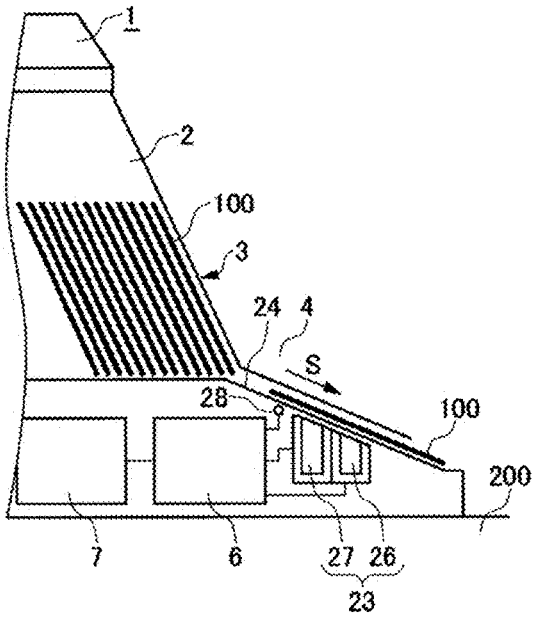
FIG. 2B is a partial side sectional view of the card shooter apparatus in Embodiment 1 of the present invention.

Next, the card reading unit 6 that reads the information (rank (number) and suit (heart, club, or the like)) on the cards 100 taken out from the card shooter unit 4 will be described in detail. FIG. 2A is a partial plan view mainly showing the card information obtaining unit 23 in the card shooter apparatus 1, and FIG. 2B is a partial side sectional view thereof. The plurality of cards 100 are held in the card storage unit 2, and the frontmost card 100 is slid on a slide surface 24 of the card shooter unit 4 as indicated by arrow S and fed onto a table 200. Rails 25 that guide the card 100 are provided on opposite sides of the slide surface 24 of the card shooter unit 4, and as shown, the card 100 is slid and fed with opposite sides thereof being in contact with the rails 25. Thus, the card 100 is guided along the rails 25. A card information reading DNA sensor 26 is provided on the slide surface 24. A light from a light source 27 is applied to a DNA-containing coating printed on the card 100, and the card information reading DNA sensor 26 receives a light of a predetermined frequency reflected from the DNA-containing coating.

Figure 3:
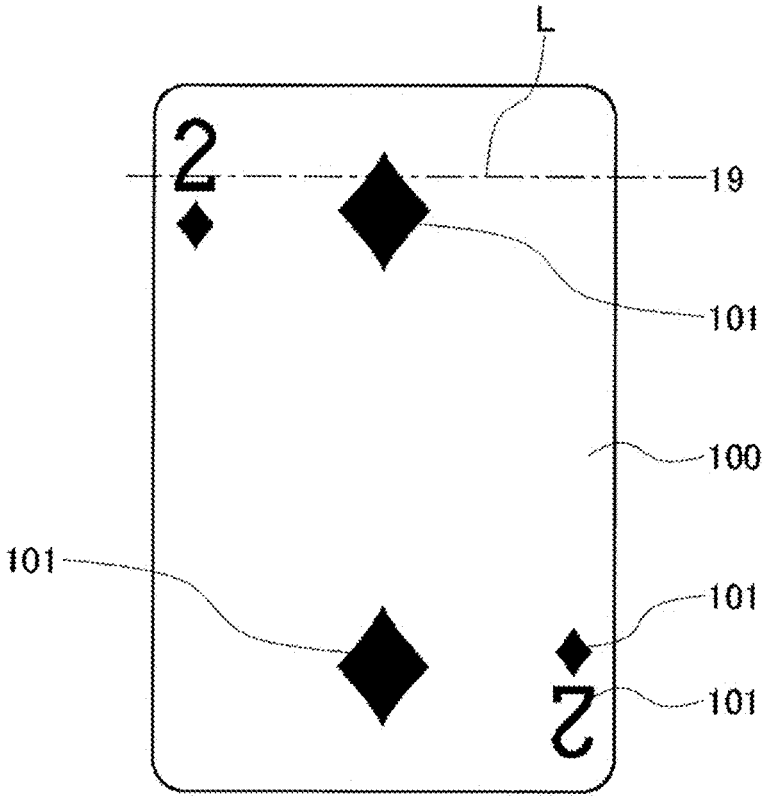
FIG. 3 is a plan view of a card on which deck information is printed in Embodiment 1 of the present invention.

FIG. 3 shows a card 100 to be inspected. Information (rank (number) and suit (heart, club, or the like)) on the card is printed on the card as DNA information. Specifically, a DNA-containing coating is mixed into ink for printing marks 101 (suit and rank) on all cards including picture cards (J, Q, K), and thus the marks are printed on the cards as DNA information. A human cannot visually recognize individual DNA in the DNA-containing coating under normal conditions of use. As an application, the DNA-containing coating may contain DNA of different types for different colors of ink for printing marks indicating suit or number so as to provide a card with a more complex configuration.

The DNA-containing coating indicating deck information is printed on a front side of the card 100, a back side on which back design is printed, or both, as a DNA-containing coating indicating deck information without information on rank (number) and suit of the card 100, separately from the DNA-containing coating indicating rank (number) and suit of the card 100.

The card information reading DNA sensor 26 reads information on the card 100 when the card 100 is guided by the rail 25 and slid. The card information reading DNA sensor 26 is placed so as to read deck information from the DNA-containing coating contained in the ink for printing the mark 101 (suit and rank) on the card 100. The light source 27 for the card information reading DNA sensor 26 to read the information is provided integrally with the card information reading DNA sensor 26. In this embodiment, the light source 27 is an LED that emits ultraviolet rays (ultraviolet LED). Such an LED is provided to reduce a size of the apparatus. A card detection sensor 28 (a light emitting element integrated with a light receiving sensor that receives a reflected light from the card, or the like) is provided upstream of the card information reading DNA sensor 26 (in a sliding direction S of the card). When detecting the card 100, the card detection sensor outputs a trigger signal to cause the card information reading DNA sensor 26 to start reading of information, the light source 27 emits ultraviolet rays, which is applied to the DNA-containing coating (the mark 101 in this case) printed on the card 100, and the card information reading DNA sensor 26 receives a light of a predetermined frequency reflected from the DNA-containing coating. The card information reading DNA sensor 26 and the card detection sensor 28 are connected to the card reading unit 6.

Next, with reference to FIGS. 4 to 7, the playing card counting unit 17 that processes a signal from the optical sensor 10 and counts the number of cards 100 stored in the card storage unit 2, the count determination unit 18 that determines from an output of the playing card counting unit 17 whether the number of cards is a predetermined number and outputs a result, the deck information obtaining unit 19 that receives a signal from the DNA sensor 11 and obtains deck information on the plurality of cards 100 stored in the card storage unit 2, and the deck information determination unit 20 that receives an output of the information obtaining unit 19, determines whether the plurality of cards 100 stored in the card storage unit 2 each have predetermined deck information, and outputs a result will be described in detail.

Figure 4:
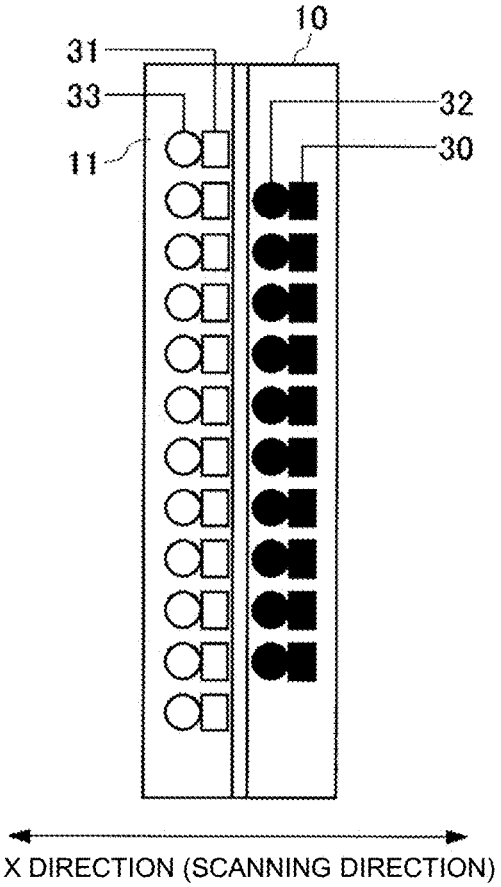
FIG. 4 is an enlarged plan view of an optical sensor and a DNA sensor in the table game system in Embodiment 1 of the present invention.
Figure 5:
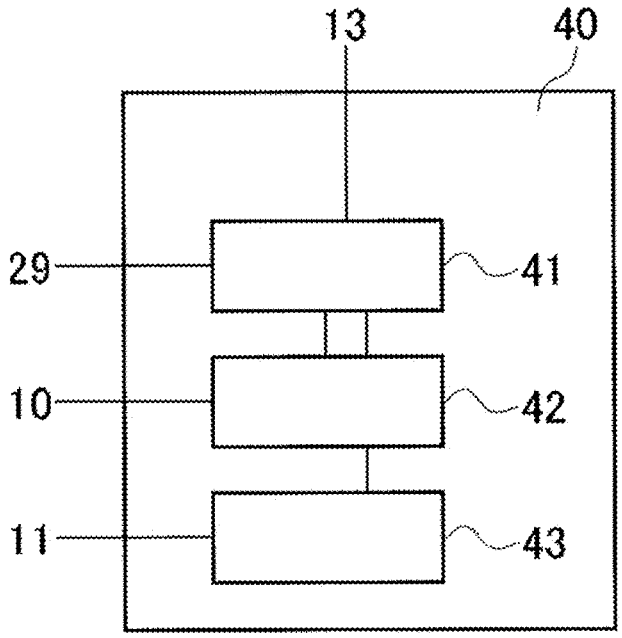
FIG. 5 is a block diagram showing an outline of a DNA determination device for reading and determining card information in Embodiment 1 of the present invention.

As shown in FIG. 4, the optical sensor 10 and the DNA sensor 11 include, in sets, a light source 30 for applying a light to an end of the card 100, a light source 31 for applying a light to the card 100 and obtaining DNA information, an element 32 that receives a reflected light of the light applied to the end surface of the card 100, and a DNA light receiving element 33 that obtains DNA information from a DNA-containing coating (described later) applied to the card 100 stored in the card storage unit 2. The optical sensor 10 and the DNA sensor 11 are configured to be movable across a predetermined section by the sensor scanning device 12, but such operations are controlled by a sensor scanning control unit 40. Operations of the sensor scanning control unit 40 and the sensor scanning device 12 will be described below. First, a reading instruction unit 41 detects a switch (not shown) to start reading of deck information, or a plurality of cards 100 being set in the card storage unit 2 and a lid 29 being closed, and instructs sensor driving units 42, 43 to start a reading operation of the optical sensor 10 and the DNA sensor 11. The reading instruction unit 41 operates the motor 13 and causes the optical sensor 10 and the DNA sensor 11 to move to scan from a position A to a position B shown in FIG. 1. Thus, the optical sensor 10 receives a reflected light of a light applied to the end surface of the card 100, and the DNA sensor 11 obtains DNA information from the DNA-containing coating (described later) applied to the card 100 stored in the card storage unit 2 and reads deck information.

Figure 6:
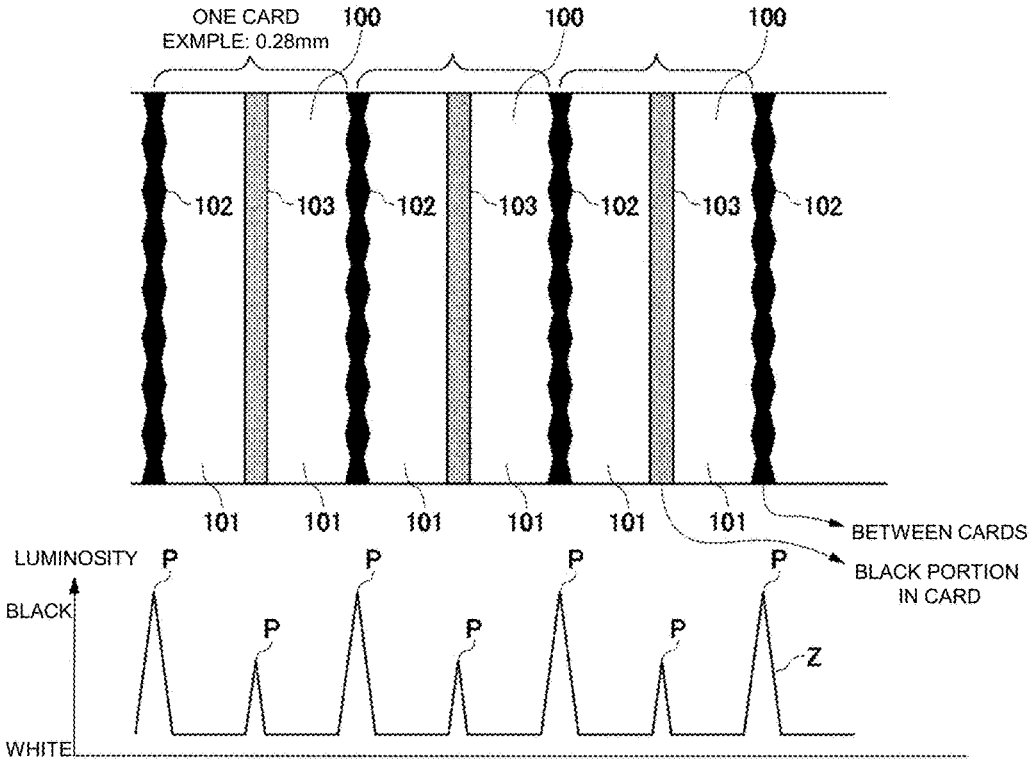
FIG. 6 illustrates a relationship between end surfaces of cards and an output of the optical sensor in the table game system in Embodiment 1 of the present invention.

FIG. 6 shows a relationship between the plurality of cards 100 seen from below in an enlarged manner, and an output of the optical sensor 10. As shown by a signal Z in a lower part of FIG. 6, the output of the optical sensor 10 is low at a white portion 101 in the card 100, and a signal intensity is high in a clearance 102 between the cards 100 and at a black portion 103 present in the card 100, and a characteristic of each portion can be detected. Even if the signal intensity at the white portion 101 in the card 100 and the signal intensity in the clearance 102 between the cards 100 and at the black portion 103 in the card 100 are inversed depending on signal processing by the image processing unit 16, a characteristic of each portion can be detected.

Based on the signal Z, the playing card counting unit 17 counts peaks P of the intensity of the signal Z to count the cards. In this manner, the playing card counting unit 17 decides the number of cards from the minute clearances 102 between the plurality of cards stored and stacked in the card storage unit 2 or the black portions 103 present in the cards 100. As an application, the peaks P for both the clearances 102 and the black portions 103 may be counted to decide the number of cards, or the number of the plurality of cards may be decided based on information obtained from the optical sensor 10 on the white portions 101 in the card 100 via the peak signals P.

FIG. 6 shows a relationship between the plurality of cards 100 seen from below in an enlarged manner, and an output of the optical sensor 10. As shown by a signal Z in a lower part of FIG. 6, the output of the optical sensor 10 is low at a white portion 101 in the card 100, and a signal intensity is high in a clearance 102 between the cards 100 and at a black portion 103 present in the card 100, and a characteristic of each portion can be detected. Even if the signal intensity at the white portion 101 in the card 100 and the signal intensity in the clearance 102 between the cards 100 and at the black portion 103 present in the card 100 are inversed depending on signal processing by the image processing unit 16, a characteristic of each portion can be detected. For a game card, a black portion 103 is provided at a middle between a front side and a back side of the card in order to prevent suit or rank on the front side from being seen through from the back side.

As shown by the signal Z in the lower part of FIG. 6, the output of the optical sensor 10 is low at the white portion 101 in the card 100, and the signal intensity is high in the clearance 102 between the cards 100 and at the black portion 103 present in the card 100. Thus, a position of each card 100 can be known from the output of the optical sensor 10.

As an application, the control unit 5 may further include a number registration unit (not shown) that previously registers a predetermined number of cards 100 to be stored in the card storage unit 2, and the count determination unit 18 may determine whether the number of the plurality of cards stored in the card storage unit 2 is the predetermined number set by the number registration unit.

Figure 7:
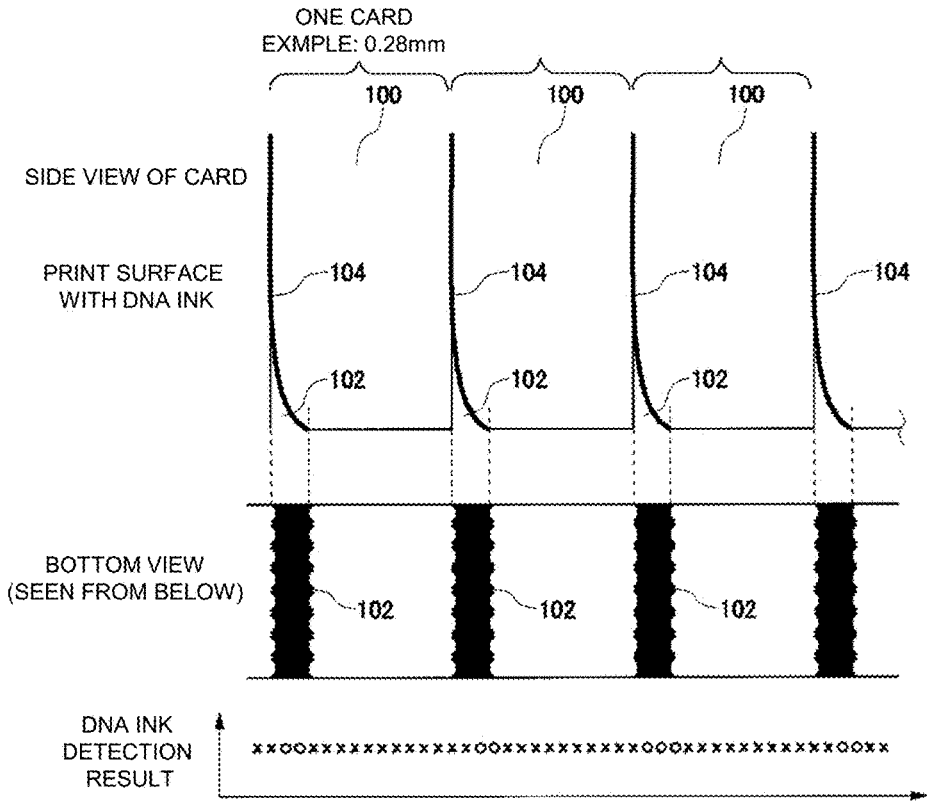
FIG. 7 illustrates a relationship between the cards and an output of the DNA sensor in the table game system in Embodiment 1 of the present invention.

FIG. 7 shows a relationship between the plurality of cards 100 seen from side and below in an enlarged manner, and an output of the optical sensor 10. As shown by a signal in a lower part of FIG. 7, the output of the DNA sensor 11 is processed by the deck information obtaining unit 19 by extracting particular DNA information as deck information. There is an output in a portion with DNA ink (or a coating) 104 including DNA information (circle-mark), and this portion can be differentiated from a portion without DNA ink (or a coating) 104 (cross-mark), and each deck information can be detected.

The cards 100 used in the table 200 used for each game are stored in a memory (not shown) as correct deck information previously set. For baccarat, it is supposed that deck information on regular cards is set for each casino, or deck information on cards to be distributed is registered for each table used. An important point is that particular DNA information as deck information on the card 100, and a DNA-containing coating indicating the information (rank (number) and suit (heart, club, or the like)) on the card 100 are separate. The information (rank (number) and suit (heart, club, or the like)) on the card 100 is read by the card reading unit 6 and the card information obtaining unit 23. The deck information on the card 100 is read by the deck information obtaining unit 19.

The optical sensor 10 and the DNA sensor 11 are secured to each other, and thus output signals from the optical sensor 10 and the DNA sensor 11 can be compared to each other. As a result, by knowing the peak P of the intensity of the signal Z from the optical sensor 10, for example, a distance between the clearances 102 or the black portions 103 present in the cards can be measured to recognize a thickness of each card 100 (about 0.28 mm), and it can be determined whether each card 100 having such a thickness includes the DNA-containing coating as deck information. The DNA-containing coating as deck information is printed on a front side of the card 100 on which rank (number) and suit are printed, a back side on which back design is printed, or both, but in this embodiment, the DNA-containing coating as deck information can be detected for each card 100.

Based on deck information 104 for each card 100 processed by the deck information obtaining unit 19, the deck information determination unit 20 compares the deck information on the plurality of cards stored in the card storage unit with deck information on the regular cards, and determines whether the deck information is the deck information previously set and stored. Also, the deck information determination unit 20 further determines whether the plurality of cards stored in the card storage unit have entirely equal deck information and outputs a result. As an application, the deck information determination unit 20 may further determine whether the plurality of cards stored in the card storage unit 2 have entirely equal deck information and outputs a result.

An important point in this embodiment is that as described above, the deck information obtaining unit 19 that obtains deck information on the card 100 does not have a function of reading information (rank (number) and suit (heart, club, or the like)) on the card 100, and does not read such information. The information (rank (number) and suit (heart, club, or the like)) on the card 100 is read by the card reading unit 6 and the card information obtaining unit 23, which are provided separately from the deck information obtaining unit 19 that obtains the deck information on the card 100. The DNA-containing coating indicating deck information and the DNA sensor that detects the DNA-containing coating are independently used, and information (rank (number) and suit (heart, club, or the like)) on the card 100 cannot be known from outside before a game. The deck information of the DNA-containing coating is an example of deck information that cannot be visually read by human but is readable under a predetermined condition.

Embodiment 2

Now, Embodiment 2 of a table game system of the present invention will be described in detail.

Figure 8:
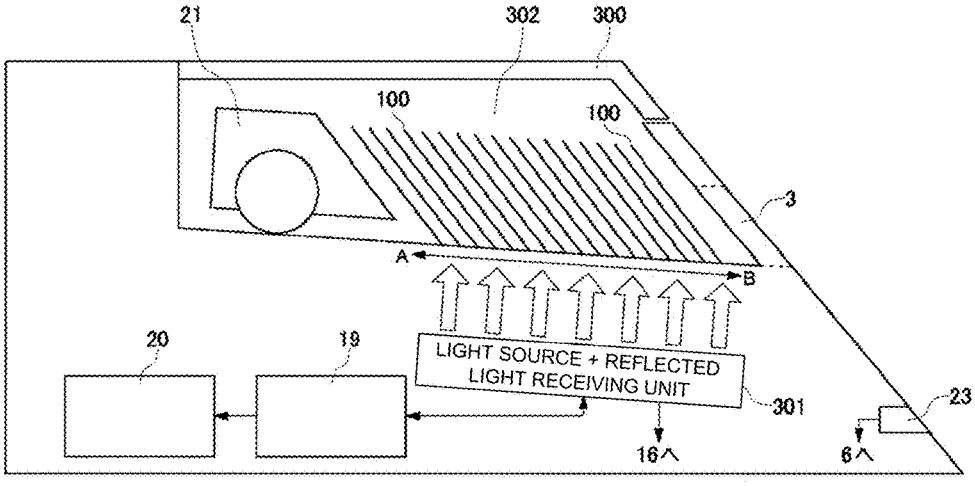
FIG. 8 illustrates an outline of a card shooter apparatus in a table game system in Embodiment 2 of the present invention.

FIG. 8 shows a configuration of a card shooter apparatus 300 in a table game system in Embodiment 2 of the present invention, and the same components as in Embodiment 1 are denoted by the same reference numerals. In Embodiment 2, a DNA sensor 301 is not moved to scan by a sensor scanning unit, but is fixedly placed across a section W so as to receive reflected lights from end surfaces of all of a plurality of cards 100 stored in a card storage unit 302. An optical sensor (not shown) that obtains information on the cards 100 is similarly fixedly placed across the section W.

A DNA-containing coating is applied to the card in the present invention as an anchor coating that adjusts a base of a card sheet to constitute deck information. The deck information can be read from the anchor coating. The DNA-containing coating may be applied to the card as an external coating of the card. A configuration in which a DNA-containing coating indicating deck information is applied to the card as at least a part of a coating for printing on back design of the card, or a configuration in which a DNA-containing coating contains multiple types of DNA and deck information is constituted by one or more of the multiple types of DNA to make it more difficult for a rigger to decode the information, or the like are conceivable as effective means.

A determination result may be output by an alarm sound, or a sound other than an alarm sound, for example, a voice message or a melody.

A deck for the deck information may be one deck or a plurality of decks. As deck information that provides the same result, deck information other than for each casino or table may be of course used. The deck information may be of different type for each card source (card shoe, or the like), or a different deck code may be set for each production lot or each casino used.

Further, the DNA-containing coating may be applied to the card in the present invention as an anchor coating of the card, the DNA-containing coating may be applied to the card as an external coating of the card, the DNA-containing coating may be applied to the card as at least a part of a coating for printing on back design of the card, the DNA-containing coating may contain multiple types of DNA, and the deck information may be constituted by one or more of the multiple types of DNA.

It is also conceivable that the DNA-containing coating as deck information is applied to the card as a special mark for deck information different from back design or marks indicating number or suit of the card.

Next, DNA ink used in the present invention will be described. The DNA ink is developed by nanotechnology and molecular science, and DNA is combined to constitute a sign code or an encrypted code to provide a security function using invisible DNA. Sign codes or encrypted codes with DNA of substantially infinite types (about 30 trillion or more) including complexes of chemical substances having sizes of a single atom to a polymer, about 0.5 to 5 microns, and can be easily produced or reproduced. In order to prevent forging or reading, a true sign code may be hidden in many fake codes. It is almost impossible for a forger to replicate the same sign code and also to identify a true sign code, which provides high security. The sign code or the encrypted code with DNA is transparent and invisible, and if used in a transparent liquid or ink, mixing of the DNA cannot be normally found. It is extremely difficult to remove, inactivate, or eliminate a function of the sign code with DNA ink mixed or added.

If a particular light such as a UV light or the like of a narrow band is applied to the sign code with DNA, a complex light is reflected having a combination of particular wavelengths according to the sign code. The reflected light is converted into an electric signal by an optical sensor (optoelectronic sensor), and the signal is decoded to allow determination of presence or absence of an intended sign code. A small amount of DNA that constitutes the sign code or the encrypted code may be mixed in a target substance such as pulp, ink, or varnish and used. The DNA is stable and does not affect the target substance, and thus use of the DNA ink or the like does not affect a normal production process and a production speed.

The DNA can be determined substantially in real time (actually, 0.01 seconds or less) using a device for decoding an optoelectronic signal returned when a particular light is applied to a target object. Common hologram or the like is visible, and, for example, a particular metal particle or the like used as deck information can be replicated even if it is invisible. Thus, such conventional methods have a disadvantage as compared to the method using DNA.

This embodiment uses the DNA-containing coating and the DNA sensor that detects the DNA-containing coating. The deck information of the DNA-containing coating is an example of deck information that cannot be visually read by human but is readable under a predetermined condition. As DNA for encoding deck information, for example, naturally-derived DNA, artificial DNA, or the like can be used. A molecular sequence having a periodical sequence such as a DNA base sequence can be used for encoding deck information. For example, an amino acid sequence of protein may be used to encode deck information. In this case, a molecular sequence sensor is used that reads a molecular sequence of cards (cards each having a molecular sequence for encoding deck information indicating a deck of cards) and obtains molecular sequence information.

Embodiment 3

Figure 9:
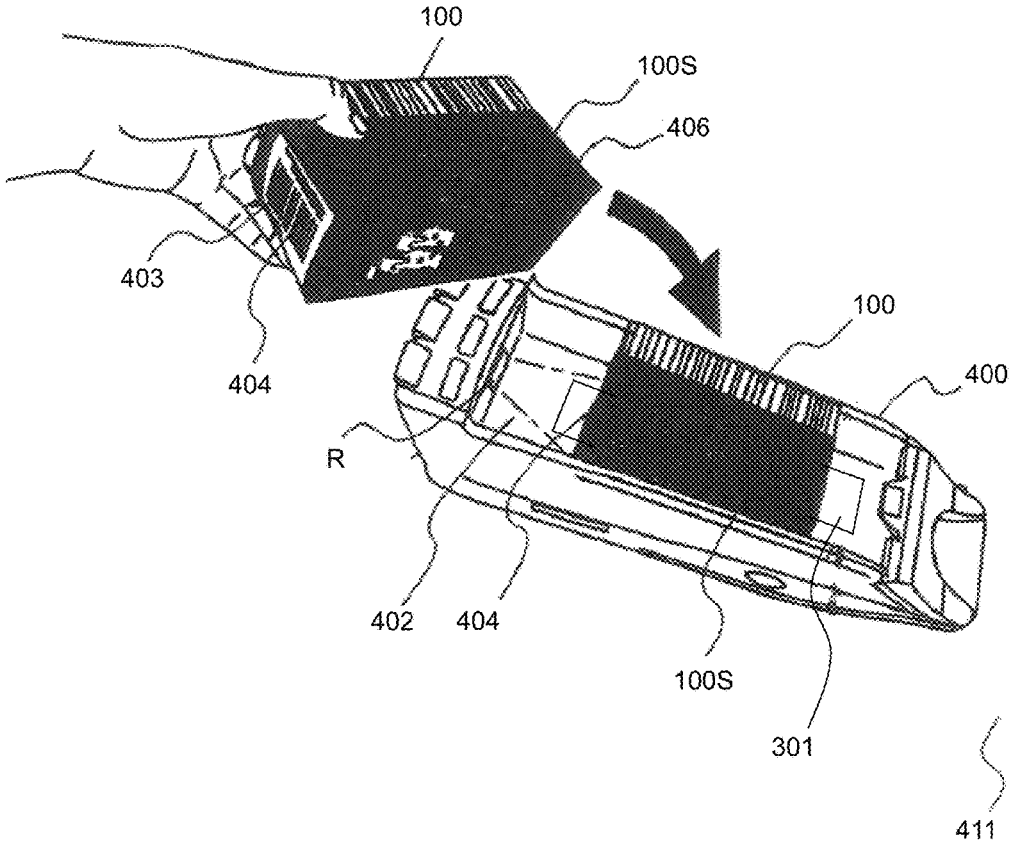
FIG. 9 is a perspective view of a package and the card shooter apparatus to be used in a card shooter apparatus in a table game system in Embodiment 3 of the present invention.

Now, Embodiment 3 of a table game system of the present invention will be described in detail. Further this embodiment 3 may be applied to both the embodiment 1 and the embodiment 2. FIG. 9 is a perspective view of a package 406 and the card shooter apparatus 400 to be used in a card shooter apparatus 400 in a table game system in Embodiment 3 as an application example of Embodiment 2 of the present invention.

The cards 100 of each shuffled playing cards 100*s*, which made up of a predetermined number of decks (normally, 6, 8, 9 or 10 decks), are shuffled in a random order to be arranged in a unique and random arrangement order and packaged as package 406 with a uniquely identifiable shuffled card ID (as a barcode 403 or a RFID tag etc.) as a ID code 404 in a factory (not shown). In this embodiment the ID code 404 is attached to the package 406 in a form of a barcode 403 (it may be 2-dimensional code like QR code) or a RFID tag etc. for a barcode reader R of a card shooter apparatus 400 or other RFID tag reading means (not shown). The package 406 is sealed with a sealing material or a shrink packaging material in a factory (not shown).

Just before breaking the package 406 on the game table 411, ID codes 404 of the packages 406 is read in the state that the package 406 is placed in the card storage unit 402 of the card shooter apparatus 400 after removal of the part of packing material of the package 406 by the barcode reader R provided at the card storage unit 402 for the purpose of acknowledging the ID codes 404 of the packages 406 to be used in each playing table 411. It becomes possible because the barcode reader R is provided inside the card storage unit 402 and the barcode reader R faces inside the card storage unit 402 that ID codes 404 of the package 406 is read in the state that the package 406 is placed in the card storage unit 402.

The card shooter apparatus 400 according to the embodiment 3 may have output unit (not shown) which outputs the determination result of the count determination unit, which was already explained in the embodiments 1 and 2, with the ID code 404 of the package 406 in which the plurality of cards stored in the card storage unit 402. Further, the card shooter apparatus 400 may have the communication unit which transmits the determination result with the ID code 404 of the package 406.

In the above explanation regarding the embodiment 3 and FIG. 9, it is described that the card shooter apparatus 400 is used in the present invention. However, not limited to the card shooter apparatus 400 but another apparatus may be used in the present invention if that apparatus has a card storage unit 402 which is capable of storing the cards packed in the package 406 to be used from now on the game table 411.

Various embodiments of the present invention have been described above, but the embodiments may be of course modified by those skilled in the art within the scope of the present invention. For example, the present invention may be applied to a game other than baccarat, such as blackjack, and the apparatus of the embodiments may be modified according to the needs of a game applied.

Preferred embodiments of the present invention conceivable at the present time have been described. Various modifications may be made to the embodiments, and appended claims encompass all of such modifications within the true spirit and the scope of the present invention.

INDUSTRIAL APPLICABILITY

The card shooter apparatus in the table game system according to the present invention allows inspection that a predetermined number of cards (416 cards in eight decks) are prepared with the plurality of cards being in the card shooter apparatus, and is useful in a table game system or the like used in a casino or the like.

REFERENCE SIGNS LIST

1 card shooter apparatus
2 card storage unit
4 card shooter unit
10 optical sensor
11 DNA sensor that obtains DNA information
100 card
100*s* shuffled playing card
400 card shooter apparatus
402 card storage unit
403 barcode
404 ID code
406 package
411 game table
R barcode reader

The invention claimed is:

1. A card counting apparatus comprising:

an optical sensor that is placed below the bottom of a card storage unit that stores a plurality of cards and receives reflected light of light applied to an end surface of the plurality of cards stored in the card storage unit; and a playing card counting unit that receives a signal from the optical sensor and counts the entire number of the plurality of cards stored in the card storage unit, wherein the optical sensor is placed so as to receive reflected light from end surfaces of all of the plurality of cards stored in the card storage unit, or configured to be movable across a predetermined section by a sensor scanning unit so as to receive reflected light from end surfaces of all of the plurality of cards stored in the card storage unit.

2. The card counting apparatus according to claim 1, wherein the playing card counting unit is configured to decide the entire number of the plurality of cards based on information obtained from the optical sensor on a minute clearance between the plurality of cards stored and stacked in the card storage unit or a black portion present in the cards, or both the minute clearance and the black portion.

3. The card counting apparatus according to claim 1, further comprising a count determination unit that determines from an output of the playing card counting unit whether the entire number of the plurality of cards stored in the card storage unit is a predetermined number.

4. The card counting apparatus according to claim 3, further comprising a display unit that displays a determination result by the count determination unit.

5. The card counting apparatus according to claim to 4, further comprising a communication unit which transmits the determination result of the count determination unit.

6. The card counting apparatus according to claim to 5, wherein the communication unit is capable of wireless transmission.

* * * * *